US007219801B2

(12) United States Patent
Christian

(10) Patent No.: US 7,219,801 B2
(45) Date of Patent: May 22, 2007

(54) MASCARA BRUSH AND KIT

(76) Inventor: Brenda Aarons Christian, 108 Azalea Point Dr. South, Ponte Vedra Beach, FL (US) 32082

( * ) Notice: Subject to any disclaimer, the term of this patent is extended or adjusted under 35 U.S.C. 154(b) by 0 days.

(21) Appl. No.: 10/847,417

(22) Filed: May 17, 2004

(65) Prior Publication Data

US 2005/0252824 A1 Nov. 17, 2005

(51) Int. Cl.

| | |
|---|---|
| ***B65D 69/00*** | (2006.01) |
| ***A45B 3/18*** | (2006.01) |
| ***A45B 11/00*** | (2006.01) |
| ***A45B 15/00*** | (2006.01) |
| ***A46D 40/26*** | (2006.01) |

(52) U.S. Cl. ..... 206/581; 15/106; 15/160; 15/207.2; 132/218; 132/313; 132/317; 206/229; 401/129

(58) Field of Classification Search ..... 206/581, 206/229; 132/218, 293–294, 313–314, 317, 132/320; 401/118, 122, 129; 15/106, 160, 15/164, 206–207, 207.2; D4/119, 127, 130–133, D4/135; D28/7

See application file for complete search history.

(56) References Cited

U.S. PATENT DOCUMENTS

| | | | | |
|---|---|---|---|---|
| 2,534,100 A | | 12/1950 | Baumgartner | |
| 2,829,655 A | | 4/1958 | Bau | |
| 3,097,386 A | * | 7/1963 | Marani | 401/129 |
| 3,921,650 A | | 11/1975 | Montgomery | |
| 4,421,127 A | * | 12/1983 | Geer | 132/294 |
| 4,589,430 A | | 5/1986 | Sussman | |
| 4,598,723 A | * | 7/1986 | Cole | 132/218 |
| 4,826,014 A | * | 5/1989 | Schefer | 206/581 |
| 4,889,228 A | | 12/1989 | Gueret | |
| 4,898,195 A | | 2/1990 | Sussman | |
| 5,205,301 A | | 4/1993 | Nakamura | |
| 5,226,744 A | | 7/1993 | Kemmerer | |
| 5,309,929 A | | 5/1994 | Toll | |
| 5,450,865 A | | 9/1995 | Park | |
| 5,765,573 A | | 6/1998 | Gueret | |
| 5,813,420 A | | 9/1998 | Sussman | |
| 5,853,011 A | | 12/1998 | Gueret | |
| 5,937,871 A | * | 8/1999 | Clay | 132/218 |
| 5,970,989 A | | 10/1999 | Litton | |

(Continued)

OTHER PUBLICATIONS

PCT/US05/15515 Notification of Transmittal of The International Search Report (Mar. 30, 2006).

*Primary Examiner*—Bryon P. Gehman
(74) *Attorney, Agent, or Firm*—Woodard, Emhardt, Moriarty, McNett & Henry LLP

(57) ABSTRACT

A mascara kit for applying mascara to numerous person's eyelashes. The mascara kit includes a kit container for holding: a mascara container, a cleanable palette suitable for receiving mascara, and a brush having bristles arrayed in a concave shape. In one form, the brush includes a handle with an axis such that the axis aligns with a focus of the concave shape of the bristles. To use the mascara kit, an amount of mascara is transferred from the mascara container to a clean palette. Next, a user applies the amount of mascara from the palette to her eyelashes with a clean applicator. Further, for another mascara application another user can transfer an amount of mascara to either the cleansed palette or that user can dispose of the palette and use another palette to transfer an amount of mascara from the mascara container to the palette.

15 Claims, 3 Drawing Sheets

U.S. PATENT DOCUMENTS

| | | | | |
|---|---|---|---|---|
| 5,970,990 | A | 10/1999 | Dunton et al. | |
| 6,026,824 | A | 2/2000 | Gueret | |
| 6,073,634 | A | 6/2000 | Gueret | |
| 6,076,531 | A | 6/2000 | Gueret | |
| 6,158,912 | A * | 12/2000 | Miraglia et al. | 401/129 |
| 6,189,698 | B1 * | 2/2001 | Asser | 206/581 |
| 6,241,411 | B1 | 6/2001 | Brieva et al. | |
| 6,505,632 | B1 | 1/2003 | Toll et al. | |
| 6,572,296 | B2 * | 6/2003 | Schrepf | 401/122 |
| 6,631,806 | B2 * | 10/2003 | Jackson | 206/581 |
| 6,675,814 | B2 | 1/2004 | Gueret | |
| 6,766,907 | B2 * | 7/2004 | Jackson | 206/581 |
| RE38,755 | E * | 7/2005 | Gueret | 132/218 |
| 2002/0014434 | A1 * | 2/2002 | Mathiez | 206/581 |
| 2002/0020424 | A1 | 2/2002 | Gueret | |
| 2002/0020426 | A1 | 2/2002 | Gueret | |
| 2002/0029786 | A1 | 3/2002 | Sunago | |
| 2002/0104547 | A1 | 8/2002 | Stevenson | |
| 2002/0139385 | A1 * | 10/2002 | Gueret | 132/218 |
| 2002/0174877 | A1 | 11/2002 | Gueret | |
| 2004/0035745 | A1 * | 2/2004 | Jackson | 206/581 |
| 2004/0173498 | A1 * | 9/2004 | Lee | 206/581 |
| 2004/0226573 | A1 * | 11/2004 | Gueret | 132/218 |

* cited by examiner

MASCARA BRUSH AND KIT

BACKGROUND

The present invention generally relates to a mascara kit for packaging a mascara container, an applicator, and a palette and the application of mascara to a person's eyelashes.

Various techniques have been employed to package mascara and apply the mascara to a person's eyelashes. One technique to package mascara uses a compact with two compartments. The first compartment stores mascara in the form of a loaf or cake and the second compartment stores a brush. The user dips the brush into the loaf of mascara and applies the mascara from the brush to her eyelashes each time the user desires to apply mascara to her eyelashes. The repeated steps of dipping the brush into the mascara loaf and applying the mascara from the brush to eyelashes can transfer bacteria, viruses or other infectious agents or irritants from the user's eye to the mascara loaf and also transfers bacteria, viruses or other infectious agents or irritants from the mascara loaf to the user's eye. Thus it is not sanitary for two or more persons to share a compact because the mascara loaf itself can not be readily sanitized between uses. Even for use by just one person, there is the potential for reinfection.

Another technique packages a tube of mascara with a brush that is inserted and stored in the tube. The user removes the brush from the tube and applies the mascara from the brush to her eyelashes. The user repeatedly dips the brush into the tube to apply mascara to her eyelashes, which allows bacteria, viruses or other infectious agents or irritants to transfer via the user's eye to the brush and then to the mascara with the potential for reinfection from subsequent use by the user or by further infection if used by another user. Furthermore, the user cannot readily gauge either the amount of mascara left in the tube or whether the mascara has dried out. Thus, there is a demand for further contributions in this area of packaging and application of mascara.

SUMMARY OF INVENTION

One form of the present invention concerns a mascara kit that includes a kit container for holding a mascara container, a cleanable palette, and a brush. The cleanable palette is suitable for receiving mascara from the mascara container. The brush includes bristles arrayed in a concave shape.

Another form of the present invention includes a mascara applicator. The mascara applicator has a long and narrow handle with an axis along the length of the handle. The mascara applicator also has a brush with bristles arrayed in a concave shape. Preferably, the focus of the concave shaped bristles aligns with the axis of the handle. In use, the ends of the bristles have mascara.

In a further form of the present invention, there is provided a mascara container, a palette, and an applicator. A user transfers an amount of mascara for one use or application from the container to a clean portion of the palette. Next, the user applies the mascara on the palette to her eyelashes with the clean applicator. For another application of mascara, the user can either clean the palette or the user can dispose of the palette and use another palette to transfer an amount of mascara from the container to the palette. In this form of the invention, the applicator preferably has concave shaped bristles, but may be alternatively shaped or may be made of a material other than bristles, such as, for example, foam or plastic.

Other forms, embodiments, objects, features, advantages, benefits and aspects of the present invention shall become apparent from the detailed drawings and description contained herein.

DESCRIPTION OF SELECTED PREFERRED EMBODIMENTS

Figure 1:
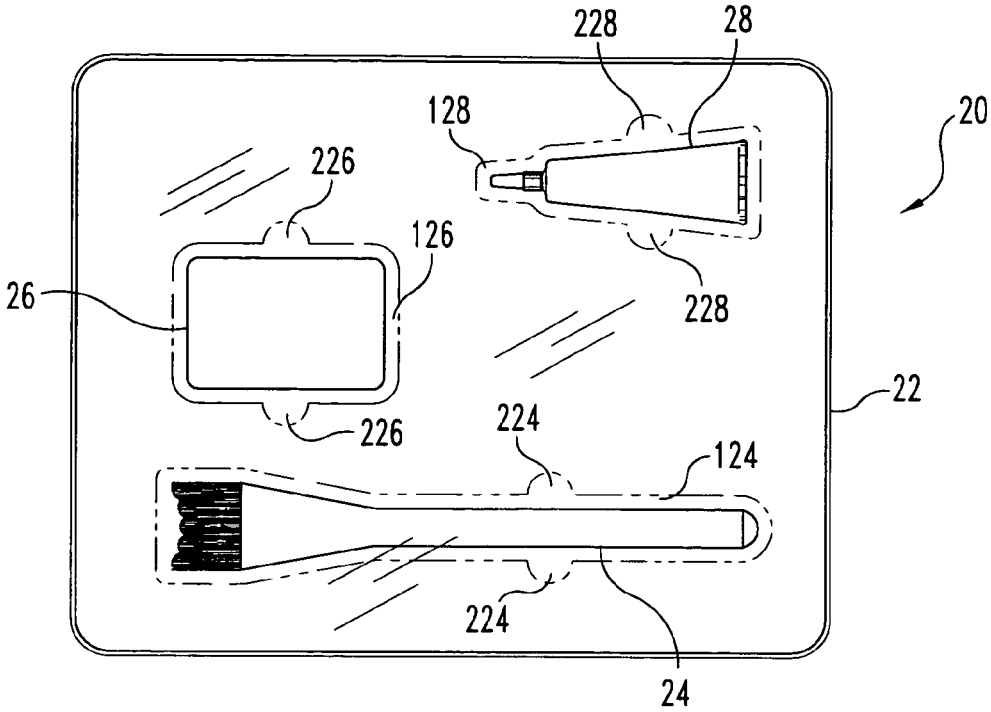
FIG. 1 is a top view of a mascara kit according to one embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

A mascara kit 20 according to one embodiment among others, of the present invention will now be described with reference to FIG. 1. As shown, the mascara kit 20 includes a kit container 22 for holding an applicator 24, a palette 26, and an eye cosmetic container 28, preferably containing mascara. In the illustrated embodiment, the kit container 22 is a rectangular shape but it should be appreciated that the kit container 22 can be various geometric shapes such as, but not limited to, circular, triangular, or elliptical. The kit container 22 can be made of materials such as, plastic, metal, or wood, to name a few. Kit container 22 is shown with a recessed area 124 contoured for applicator 24 with further recessed areas 224 for fingers to grasp the brush. Similarly there is a recessed area 126 contoured for palette 26 with further recessed areas 226 for fingers to grasp the palette. As well, there is a recessed area 128 contoured for eye cosmetic container 28, with further recessed areas 228 for fingers grasping container 28 when in the recessed area. In another embodiment, the kit container 22 can be formed with internal compartments to store the applicator 24, the palette 26, and the eye cosmetic container 28. In yet another embodiment, the kit container 22 can have additional compartments for storing other cosmetics or applicators, and may have a lid.

Figure 2:
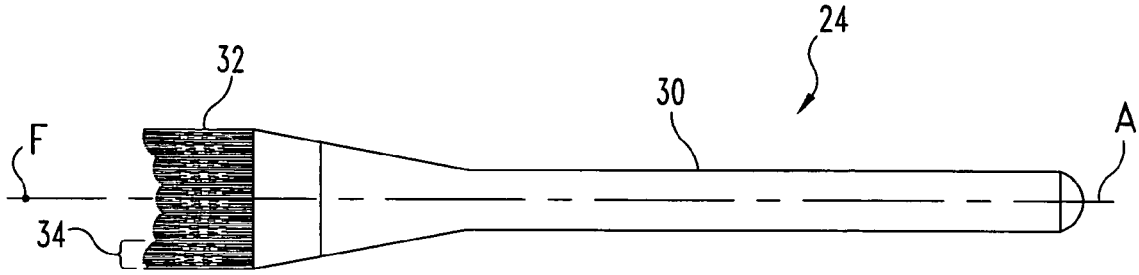
FIG. 2 is a top view of a brush according to another embodiment of the present invention.

As depicted in FIG. 2, the applicator 24 includes a handle 30 with an axis, A, along the length of the handle 30. By way of non-limiting examples, the handle 30 can be circular, rectangular, or any other cross-sectional shape that enables a user to grasp the handle 30. Further, a surface of the handle 30 can be smooth or textured. In another embodiment, the handle 30 can be ergonomically shaped. The applicator 24 also includes a brush 32 for applying an eye cosmetic to a person's eyelashes.

Figure 3:
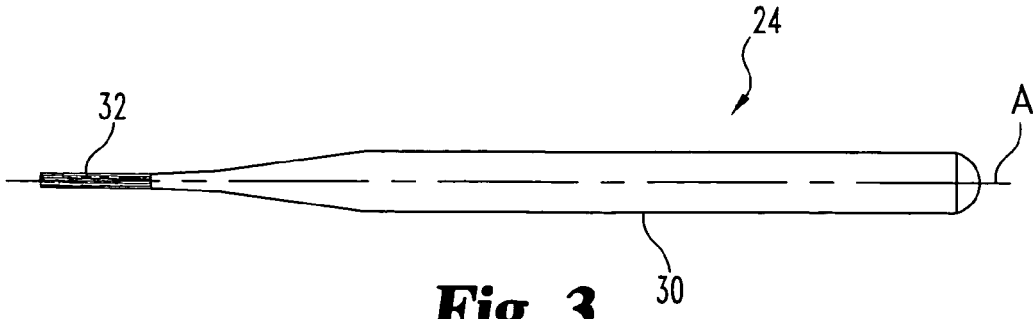
FIG. 3 is a side view of the brush in FIG. 2.

As shown in FIG. 2, the illustrated embodiment of the brush 32 includes groups of bristles 34 arrayed in a concave shape. As depicted in FIG. 2, the axis, A, of the handle 30 preferably aligns with a focus, F, of the concave shape of the brush 32. In the illustrated embodiment, the groups of bristles 34 have distinctive length variations but it should be appreciated that in other embodiments the groups of bristles 34 can have similar lengths. In the embodiment depicted in FIG. 2, each of the groups of bristles 34 preferably have lengths of approximately 0.6 inch, 0.5 inch, or 0.4 inch. In a preferred embodiment, the lengths of the groups of bristles 34 can range from approximately 0.1 inch to 1.0 inch. In the embodiment depicted in FIG. 2, the width of the brush 32 is most preferably about approximately 0.8 inch. In another embodiment, the width of the brush 32 can preferably range from 0.5 inch to 1.5 inch. In yet another embodiment the width of each of the groups of bristles 34 can vary. In the embodiment depicted in FIG. 3, the thickness of the brush 32 is most preferably about 0.1 inch. In a preferred embodiment, the thickness of the brush 32 can range from 0.05 inch to 0.5 inch. It should be appreciated that the thickness of each of the groups of bristles 34 can vary.

Figure 4:
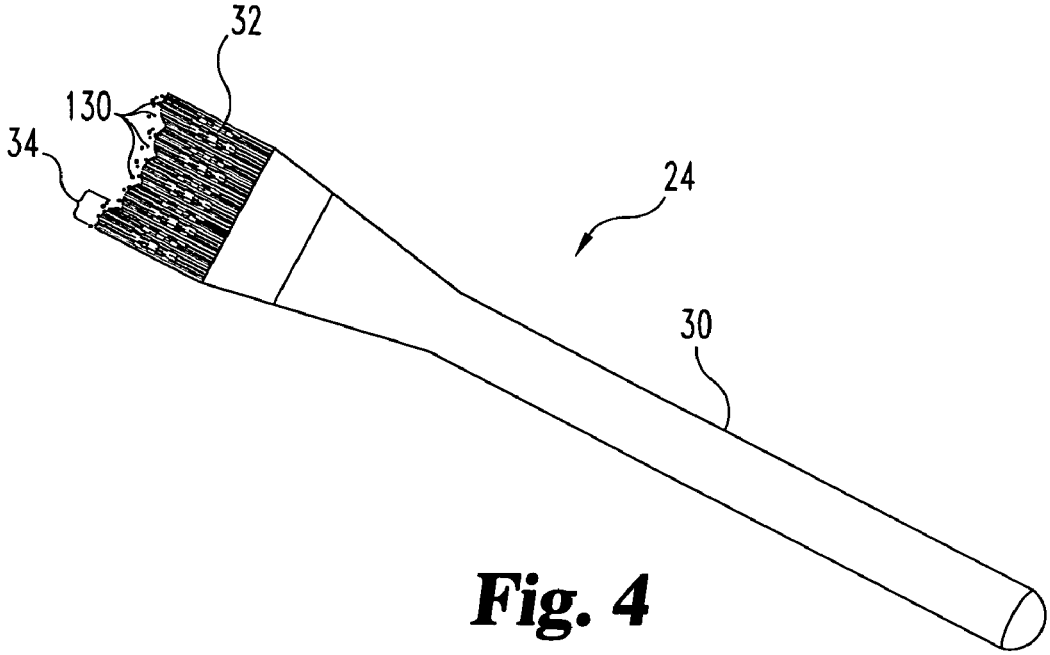
FIG. 4 is a perspective view of the brush in FIG. 2 with mascara on the end of its bristles.

In FIG. 2, the groups of bristles 34 have distinctive length variations wherein each group of bristles 34 preferably forms a generally a convex shape, however, the shape of all of the groups of bristles 34 arrayed adjacent one another preferably forms a substantially concave shape. It should be appreciated that in other embodiments, the length variations of each of the groups of bristles 34 can form different shapes such as, stepped or serrated, to name a few. Moreover, the groups of bristles 34 can be arrayed to form different shapes such as, rectangular, castled, stepped, or circular, to name a few. As shown in FIG. 4, the groups of bristles 34 form five distinct groups but it should be appreciated that in other embodiments the groups of bristles 34 can form any number of distinct groups. In a preferred embodiment, the groups of bristles 34 form a range of three to seven distinct groups of bristles 34.

Figure 5:
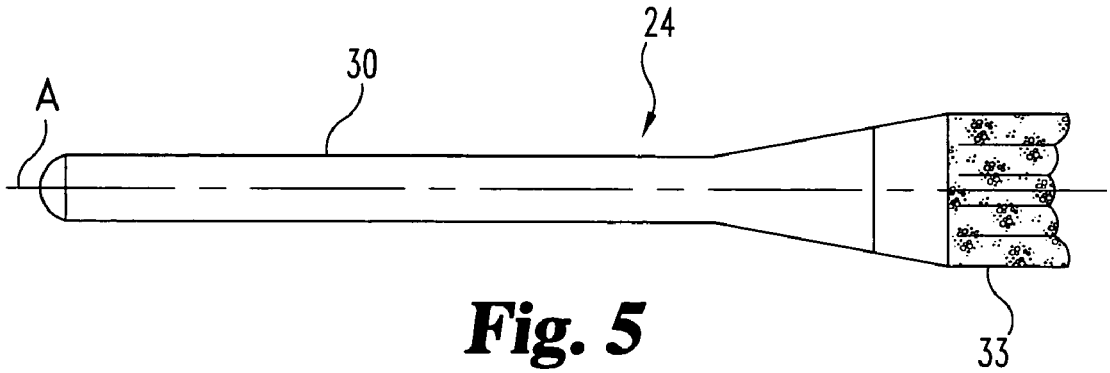
FIG. 5 is a top view of a brush according to an alternate embodiment of the present invention.

By way of non-limiting example, the brush 32 can be made of materials such as, plastic, hair, or foam to name a few. Bristles are not required for this example, although they are required for other embodiments. In the illustrated embodiment, the brush 32 is made of a material that can be cleansed after eye cosmetic applications with the brush 32. For example, numerous persons can use the same brush 32 to apply eye cosmetics and if each person cleanses the brush 32 before use, then bacteria, viruses, or other infectious agents or irritants will not be transferred from the brush 32 to the user's eyes. In a further form depicted in FIG. 5, a brush 33 is made of a disposable material on its end, such as, but not limited to, foam or plastic, formed into a concave shape. In this form, the brush 33 can be removed from the handle 30 and replaced with another brush 33, enabling each successive user to use a new brush.

Figure 6:
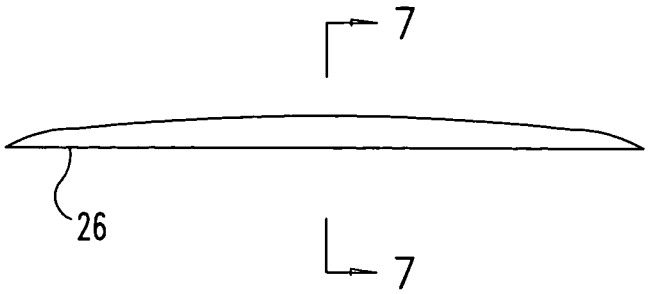
FIG. 6 is a side view of a palette according to another embodiment of the present invention.
Figure 7:
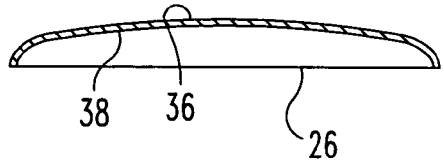
FIG. 7 is a cross section taken along line 7—7 in FIG. 6 of the palette.

One form of the palette 26 for receiving mascara is shown in FIGS. 6 and 7. In the illustrated embodiment in FIG. 7, the palette 26 has a curved shape with a convex surface 36 and a concave surface 38. The palette can be used either as shown, or inverted. When inverted, surface 38 has upwardly rising sides which can aid in retaining mascara on the surface 38, and allow a user to easily hold the palette 26. In the preferred non-inverted usage, the convex surface 36 is of such a curvature to coincide with the concave shape of the groups of bristles 34 when the groups of bristles 34 are oriented or directed towards the palette 26. It should be appreciated that in other embodiments, the palette 26 can be flat. The palette 26 can be various shapes such as circular, rectangular, or triangular, to name a few.

In one form, the palette 26 is made from a non-porous material such as plastic, ceramic, porcelain, glass, or metal, to name a few. In this form, it should be appreciated that the palette 26 can be readily cleansed and sanitized. For example, numerous persons can each: transfer an eye cosmetic to a mascara receiving surface 36 or 38 of the palette 26, use the eye cosmetic on surface 36 or 38, and cleanse the palette 26 before a subsequent user uses it. Bacteria, viruses, or other infectious agents or irritants will not be transferred from the cleansed palette 26 to a subsequent user's eye via the eye cosmetic by the mascara contact with the applicator 24. In an alternate embodiment, the palette 26 is formed from a stack of thin palettes thereby allowing each user to use one thin palette and discard or dispose of the used thin palette after use, leaving the next thin palette clean and exposed for the next use.

Figure 8:
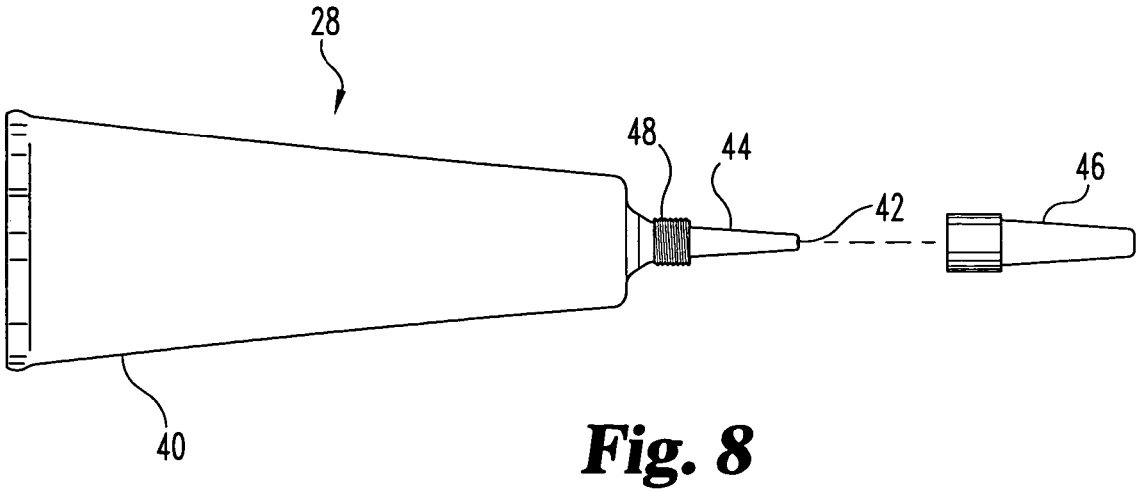
FIG. 8 is a plan view of a mascara container and removed cap according to one embodiment of the present invention.

One form of the eye cosmetic container 28 is shown in FIG. 8. In a preferred embodiment, the eye cosmetic container 28 has a tube 40 filled with mascara and an opening 42 at an end of a nose 44. In a preferred embodiment, as shown in FIG. 8, a cap 46 is sized to fit onto the nose 44 to seal the opening 42. In this form, the cap 46 has internal threads (not shown) to thread with external threads 48 of nose 44. It should be appreciated that in other embodiments, the opening 42 can be sealed differently. In the illustrated embodiment, the tube 40 is made of a flexible material such as plastic. As a user applies pressure to the tube 40, mascara flows from the nose 44 and the opening 42. By way of non-limiting example, the tube 40 can be various geometric shapes such as, circular or rectangular, to name a few. Similarly, the opening 42 can be various geometric shapes. In other embodiments, the eye cosmetic container 28 can be made of different materials, such as, metal or glass, to name a few. It should be appreciated that mascara can be dispensed from different configurations of a eye cosmetic container 28 such as, but not limited to, a pump, a pour bottle, or a twist dispenser, to name a few.

In operation, an amount of mascara appropriate for a daily use by a person is transferred from the eye cosmetic container 28 to the mascara receiving surface 36 or 38 of the palette 26. A user applies an amount of mascara from the palette 26 to her eyelashes with a clean applicator 24. That user or another user can repeatedly transfer an amount of mascara appropriate for that person's daily use to a clean and sanitary mascara receiving surface 36 or 38 of the palette 26. Further, each palette transfer is separate from other palette transfers, such that, in one form, the palette 26 is cleansed after each palette transfer. In another form, the palette 26 is disposed of after use such that a subsequent user can use a clean palette 26. Still another form, the top layer of a multilayer palette is removed exposing a clean layer beneath it. In any form, the user can repeatedly apply the amount of mascara from the palette 26 to eyelashes with the brush 32 or brush 33 such that each eyelash application is unique to the mascara of a respective clean portion of the palette 26, by using a cleaned brush or a new brush each session.

In one preferred form of mascara application, a user dips the ends of the brush 32 in mascara which has been placed on the palette 26 from eye cosmetic container 28. Further, the user applies mascara to her upper eyelid eyelashes by holding the brush 32 in a direction substantially vertical such that the concave shape of the groups of bristles 34 point in an upward direction. Next, the user moves the brush 32 in an upward direction to sweep or brush the upper eyelid eyelashes and apply mascara. To apply mascara to lower eyelashes, a user holds the brush 32 in a direction substantially vertical such that the concave shape of the groups of bristles 34 point in a downward direction. Next, the user moves the brush 32 in a downward direction to brush the lower eyelashes and apply mascara. This form of mascara application substantially curls the eyelashes while applying mascara to the eyelashes. Further, the user can hold the brush 32 substantially vertical to her eyelashes and tap or bounce the brush 32 against her eyelashes to "set" or dry the mascara and further curl her eyelashes.

In another preferred form of mascara application, the user applies mascara to her upper eyelid eyelashes by holding the brush 32 in a direction substantially vertical such that the concave shape of the groups of bristles 34 point in a downward direction. Next, the user moves the brush 32 in an upward direction to sweep or brush the upper eyelid eyelashes and apply mascara. To apply mascara to lower eyelashes, a user holds the brush 32 in a direction substantially vertical such that the concave shape of the groups of bristles 34 point in an upward direction. Next, the user moves the brush 32 in a downward direction to brush the lower eyelashes and apply mascara. This form of mascara application substantially lengthens the eyelashes and keeps mascara away from the eye during mascara application.

In another form of mascara application, a user can variegate the amount of mascara distributed onto her eyelashes with the applicator 24. The user applies mascara to her eyelashes by holding the brush 32 in a direction substantially horizontal and sweeping the brush 32 in a horizontal, side to side motion to apply mascara to her eyelashes.

Mascara can be applied to eyelashes with any combination of the mentioned forms of mascara application. It should be appreciated that other eye cosmetics, such as, but not limited to, conditioning primer, can be transferred from a container to the surface 36 or 38 of the palette 26 and applied to eyelashes in the same manner as an amount of mascara.

In one embodiment, the palette 26 is made from a non-porous material such that the palette 26 can be cleansed or sanitized after each use. Further in this embodiment, the brush 32 is made of a material that can be cleansed after eye cosmetic applications with the brush 32. In operation, a first user can dispense an amount of mascara from the eye cosmetic container 28 onto the mascara receiving surface 38 of the palette 26. Next, the first user can grasp the handle 30 and dip ends of the brush 32 into the amount of mascara on the surface 38. In a preferred form, the user dips the brush 32 into the amount of mascara on the surface 38 and wipes a side of the palette 26 to remove an excess amount of mascara from the brush 32. The first user can apply the mascara 130 from the ends of the brush 32 to her eyelashes. After the first user has applied the desired amount of mascara to her eyelashes, the first user can remove any remaining mascara and bacteria, viruses, or other infectious agents or irritants by cleansing the non-porous palette 26 and the brush 32. A second user can use the non-porous palette 26 and the brush 32 without contracting bacteria, viruses, or other infectious agents or irritants from prior use of the palette 26 and the brush 32 by the first user. It should be appreciated that other forms of the palette 26 and the brush 32 can be used without transferring bacteria, viruses, or other infectious agents or irritants between users. Thus sequencing of several successive users can be accomplished in a sanitized manner, without contamination of the stock of mascara.

In a preferred embodiment, the applicator 24 has a disposable brush 33. To apply mascara, the user grasps the handle 30 and dips the disposable brush 33 into an amount of mascara on the palette 26 and applies the mascara from the brush 33 onto her eyelashes. After the user applies the mascara to her eyelashes with the brush 33, she can dispose of the brush 33. For another application of mascara, the user attaches another brush 33 to the handle 30.

In another embodiment, the user can cleanse the brush 32 after the application of mascara to eyelashes with the brush 32. Further, successive persons can each use the brush 32 to apply mascara, cleanse the brush 32 after individual use, and then re-use the brush 32 by the next person without transferring bacteria, viruses or other infectious agents or irritants from any of the prior users' eyes.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A mascara kit, comprising:

a kit container;

a mascara container in said kit container;

a cleanable palette suitable for receiving mascara in said kit container; and a brush in said kit container, said brush having bristles and a long and narrow handle defining an axis along its length wherein the brush has a majority of the free ends of said bristles arranged in a concave minor arc wherein said axis approximately aligns with a focus of the concave minor arc.

2. The mascara kit of claim 1, wherein the mascara container is adapted to provide flow of the mascara from the container by application of pressure to the mascara within the container.

3. The mascara kit of claim 2, wherein the mascara container is a flexible tube suitable for squeezing to apply pressure within the tube.

4. The mascara kit of claim 1, wherein the palette has a convex surface.

5. The mascara kit of claim 4, wherein said convex surface is of such a curvature to coincide with the concave minor arc of said bristle free ends at some orientation of the bristles to the palette.

6. The mascara kit of claim 1, wherein the palette is made of a non-porous material.

7. A mascara applicator, comprising:

a long and narrow handle defining an axis along its length;

a brush at an end of said handle having bristles arranged in a planar arrangement;

wherein free ends of the bristles are arrayed to form a concave minor arc wherein the axis approximately aligns with a focus of the concave minor arc; and wherein ends of the bristles have mascara.

8. The mascara applicator of claim 7, wherein the long and narrow handle is a cylindrical shape.

9. The mascara applicator of claim 7, wherein the length of the bristles is within a range from 0.1 inches to 1.0 inches.

10. The mascara applicator of claim 7, wherein a thickness of the array of bristles is within a range from 0.05 inches to 0.5 inches.

11. The mascara applicator of claim 7, wherein a width of the array of bristles is within a range from 0.5 inches to 1.5 inches.

12. The mascara applicator of claim 7, wherein the free ends of the bristles are arrayed to form a concave minor arc form with distinctive groups wherein each of the groups has several bristles with distinctive length variations among them to form a pattern.

13. The mascara applicator of claim 12, wherein said pattern for each said group is a convex shape.

14. The mascara applicator of claim 12, wherein the number of groups is a range from 3 to 7.

15. The mascara applicator of claim 12, wherein the number of groups is 5.

* * * * *

UNITED STATES PATENT AND TRADEMARK OFFICE

CERTIFICATE OF CORRECTION

PATENT NO. : 7,219,801 B2
APPLICATION NO. : 10/847417
DATED : May 22, 2007
INVENTOR(S) : Christian It is certified that error appears in the above-identified patent and that said Letters Patent is hereby corrected as shown below:

In column 6, line 32, please change
"length wherein the brush has a majority of the free ends" to
--length wherein said brush has a majority of the free ends--

In column 6, line 57, please change
"concave minor arc wherein the axis approximately" to
--concave minor arc wherein said axis approximately--

Signed and Sealed this

Twenty-fourth Day of July, 2007

JON W. DUDAS
*Director of the United States Patent and Trademark Office*